US005127482A

United States Patent [19]

Rector, Jr.

[11] Patent Number: 5,127,482

[45] Date of Patent: Jul. 7, 1992

[54] EXPANDABLE MILLING HEAD FOR GAS WELL DRILLING

[76] Inventor: Clarence A. Rector, Jr., 5920 Rinconada Dr., Farmington, N. Mex. 87401

[21] Appl. No.: 603,130

[22] Filed: Oct. 25, 1990

[51] Int. Cl.[5] ..... E21B 10/62

[52] U.S. Cl. ..... 175/321; 166/242; 166/329; 175/402; 285/316

[58] Field of Search ..... 166/55.6, 242, 318, 166/328, 329; 175/314, 321, 402, 403; 285/316

[56] References Cited

U.S. PATENT DOCUMENTS

| | | | |
|---|---|---|---|
| 1,883,071 | 10/1932 | Stone . | |
| 2,462,477 | 2/1949 | Edwards . | |
| 2,670,927 | 3/1954 | Edwards . | |
| 2,682,388 | 6/1954 | Colquitt . | |
| 2,727,761 | 12/1955 | Elliott . | |
| 2,927,640 | 3/1960 | Kenneday . | |
| 2,988,145 | 6/1961 | Clark . | |
| 3,051,244 | 8/1962 | Litchfield . | |
| 3,148,894 | 9/1964 | Schwab . | |
| 3,205,948 | 11/1965 | Preston . | |
| 3,419,081 | 12/1968 | Nelson | 166/328 |
| 4,161,216 | 7/1979 | Amancharia | 166/193 |
| 4,452,472 | 6/1984 | Crase | 285/3 |
| 4,531,766 | 7/1985 | Crase | 285/18 |
| 4,601,492 | 7/1986 | George | 285/3 |

*Primary Examiner*—Terry Lee Melius
*Attorney, Agent, or Firm*—Kenton L. Freudenberg; Maxwell C. Freudenberg

[57] ABSTRACT

A tool head is separably attached to the end of a hollow well drilling string for cutting operations within a well and for detachment of the cutting head from the string without removing the string from the well. The head is attached by a ball clutch structure having a pressure responsive release mechanism responsive to an actuating pressure on the release mechanism to release the cuttiong head and the release mechanism from the string, the release mechanism having an upwardly open passage and a downward flow permitting check valve for passing cutting fluid from the string through the passage to the cutting head. Release is effected by dropping a sealing member down the drill string to close the passage and by an increase in fluid pressure above the sealing member and the release mechanism. The release mechanism includes part of the check valve which retain balls of the clutch structure to prevent detachment of the head, that part of the check valve being anchored int its retaining position by shear pins which are fracturable by the increased fluid pressure to release that valve part from its retaining position. The invention relates to the tool structure and to its method of use in drilling or for milling off the inner ends of hollow plugs in well casings to provide gas passages in the casing wall.

20 Claims, 2 Drawing Sheets

EXPANDABLE MILLING HEAD FOR GAS WELL DRILLING

BACKGROUND OF THE INVENTION

The economic viability of well drilling operations to recover underground gas can be heavily affected by the efficiency with which the drilling procedure is conducted. In a common method of producing gas from a gas well, the well is drilled and a relatively large casing sleeve inserted into the bore to a depth less than the depth from which gas is to be produced. The bore is then continued to the depth of gas production using a smaller diameter drill. A length of smaller diameter casing having a check valve at its lower end to prevent upward flow is forced down into the well, sealed to the larger casing to extend beyond the end of the larger casing to and beyond the producing area. This smaller diameter casing may be several hundred feet in length and comprise several conventional lengths of pipe, each prepared prior to use in the well by milling a plurality of circumferentially spaced holes at axially spaced intervals. These holes are tapped and initially sealed with aluminum cup-shaped plugs which have their rims screwed into the tapped holes with their open cup-rim ends flush with the exterior casing wall and their closed cup-ends protruding beyond the interior casing wall. Being sealed in this manner, the casing may be inserted into the well and through pressurized areas without allowing any significant escape or conduction of gas. Once the prepared well casing is in place within the well, the cup-end protrusions at the interior of the smaller casing are milled out using a cylindrical milling bit which shears off the aluminum plugs leaving the holes open for the passage of gas. Typically, the drill string and milling unit are removed from the well and a "production string" is reinserted to conduct gas to the ground surface.

SUMMARY OF THE INVENTION

The present invention relates to the structure of a tool which can be attached to the end of a hollow drill string, having a detachable cutting head for cutting off the inner base ends of such cup-end protrusions and which, under control of the operator, is selectively released and separated to allow the head to drop from the string after completion of a cutting operation. The invention also relates to the method of using such a tool in a gas well drilling operation.

The tool of the present invention comprises a hollow driving body which is provided with means for securing it to the end of a tubular drill string. This driving body is essentially an extension of the drill string. The hollow cylindrical center of the driving portion of the tool assembly is fitted with a spring biased ball and cup check valve. This check valve assembly comprises a single valve member having a downwardly facing seat for the ball which prevents pressure in the well from forcing its way up through the drill string but allows drilling fluid or gas to be forced into the well through the check valve. The outer diameter of the check valve assembly is the same as the inner diameter of the drill string tubing and tool assembly. The check valve body abuts a lower supporting member which is held in place axially in the string tubing by several brass shear pins.

This check valve assembly has, on the same body member carrying the check valve seat, a second identical valve seat at its opposite and upper end which allows another identical ball to be passed through the drill string to seal the check valve from above. If the drill string is then pressurized to, for example, approximately 1500 pounds per square inch to exert a predetermined net downward force on the valve assembly, the check valve assembly is forced downward against the supporting member with sufficient predetermined force to sever the brass shear pins, releasing the support member and the valve assembly within the driven member.

The milling head is essentially a flat ended cylinder which fits on the outside of the driving body and is held in place by a releasable clutch means having a first condition for interconnecting inner and outer telescoped tubular members comprising the driving body and the wall of the drilling head, respectively, and a second condition in which the clutch means is released to permit axial separation of the drilling head from the drilling tool assembly. This releasable clutch means comprises a plurality of clutch elements each of which interconnects these inner and outer members in both a rotational driving engagement and to prevent their separation by relative axial movement. The clutch elements are four steel balls which are seated in mating recesses comprising (1) hemispherical indentations or cups in the inside walls of the drilling head and (2) circular holes in the driving body. The balls abut a portion of the body member on which are located the two valve seats in the check valve assembly inside the drill string and are prevented from moving inwardly until the valve assembly is released. At that time the balls are free to fall to the inside, thereby releasing the milling head which then falls free into the well.

Because the head can be released from the drill string, the drill string need not be removed from the well in order to remove the milling head and can subsequently be used as the production string. This eliminates a step in the drilling process thus saving a substantial amount of time and increasing the efficiency of the drilling operation. Also eliminated is the difficulty and danger associated with removing the drill string from the internal well environment, which may be highly pressurized by the underground gas.

Among the objects of the invention is to provide a simple structure of few readily available or easily machined parts for releasably attaching a milling head to a drill string assembly.

Another object of the invention is to provide a milling head which can easily be jettisoned within a well in order to eliminate a step in the gas production process, thereby decreasing the danger and time required for completion of the gas production process.

A further object of the invention is to provide a method of production of gas from a well using a milling head which can easily be jettisoned from a drill string within a well in order to eliminate a step in the gas production process.

DESCRIPTION OF PREFERRED EMBODIMENT

Figure 3:
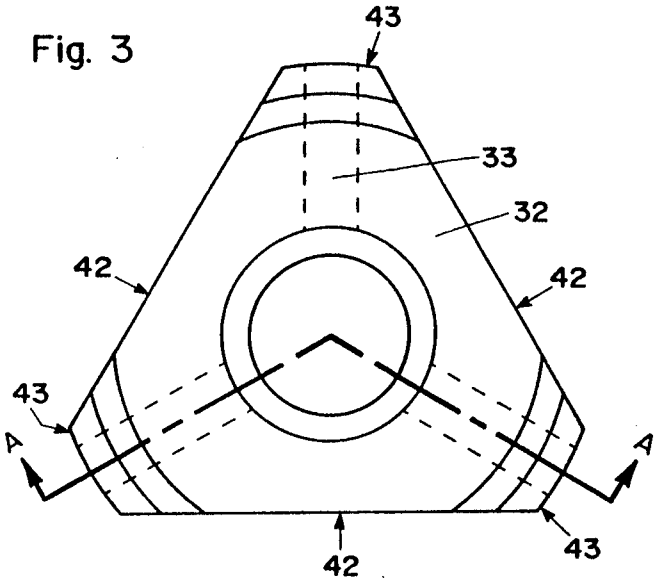
FIG. 3 is an end view of a valve assembly support member normally anchored within the milling tool driving structure.
Figure 2:
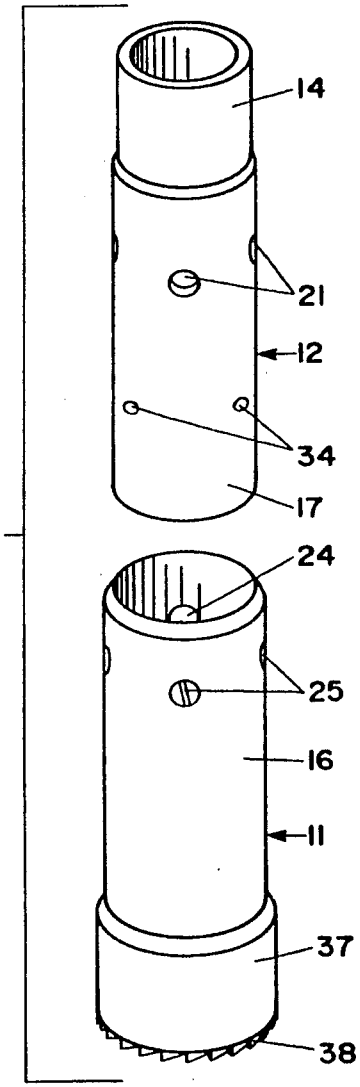
FIG. 2 is an exploded view of a milling tool showing a milling head separated from its driving structure.

A milling tool assembly 10 comprises a milling head 11 and a supporting and driving structure 12. The upper end of the driver 12 has a conventional male threaded coupling 14 for attachment to the lower female theaded end of a pipe at the lower end of a driving drill string. The head 11 includes a tubular member 16 which telescopes over a tubular member 17 forming part of the driver 12 and is attached to the tubular member 17 of the driver 12 by means of a clutch comprising a plurality of balls 20 retained within four equally circumferentially spaced holes 21 in the wall of the tubular member 17. The balls are prevented from moving inwardly toward the center of the driver 12 by a valve body 22. The balls project outwardly beyond the outer peripheral wall 23 of the tubular member 17 and are received in semispherical or cup-shaped recesses 24 in the inner wall of the tubular member 16. The cup-shaped recesses 24 are formed by cup-shaped plugs 25 which are manually threaded into and anchored within holes in the wall of driven member 16, preferably by either welding them in place or using a suitable thread-locking adhesive. Each such cup may be provided with a slot or socket to readily accept a driving tool such as a screwdriver or hex key to facilitate its installation.

The valve body 22 is a generally cylindrical member having identical annular valve seats 27 and 28 at its opposite ends and an intermediate cylindrical wall portion engaging the balls to hold them in their locking positions in the holes 21 and recesses 24 in plugs 25. Above and below this intermediate wall portion the valve body has pairs of annular grooves for O-ring seals 29. The valve body has an upwardly facing annular shoulder 30 which abuts an annular shoulder 31 on the inner wall of the driver member 17 just above the holes 21 to limit upward movement of the body 22 relative to the member 17. The valve body is retained in the uppermost position as seen in FIG. 4 by means of a support member 32 having its upper end abutting the body 22 and having near its other end a plurality of radially extending holes 33 aligned with holes 34 in the wall of driver member 17 for receiving shear pins 35 which anchor the support member against axial movement within the tubular member 17 of the driver 12.

Figure 4:
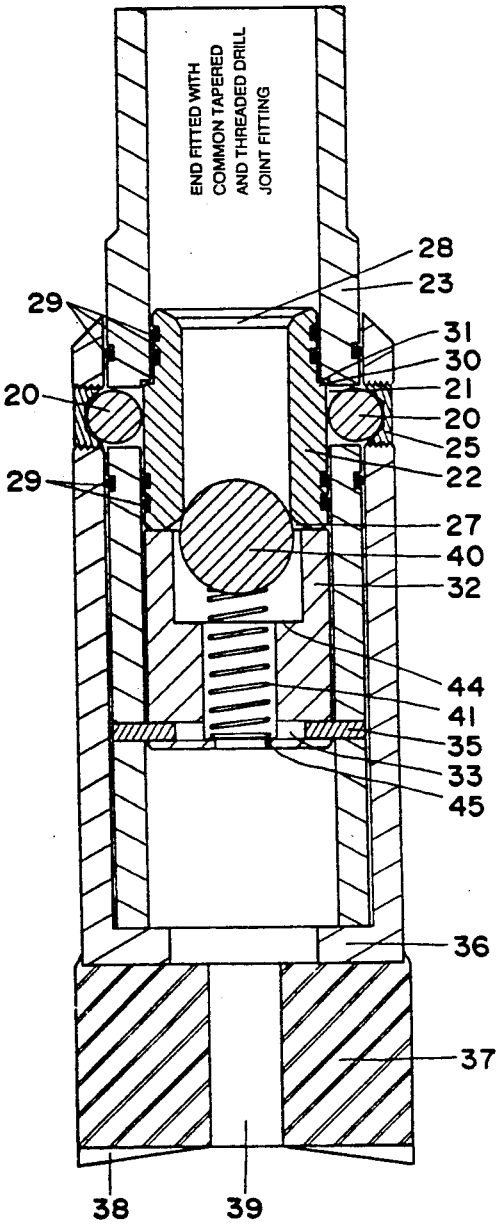
FIG. 4 is a section of the milling tool of FIG. 1 in its assembled operating configuration, but with the section for the valve assembly support member and shear pins taken on line A—A of FIG. 3.

The lower end of the tubular member 16 has an inwardly extending annular flange 36 which abuts the lower end of the tubular driving member 17 in the milling or operating position as seen in FIG. 4. This flange 36 not only serves to help transfer the axial drilling forces from the driver 12 to the head 13 independently of the clutch balls 20, but also provides a larger surface at the end of the member 16 for supporting a cutting element 37 which is welded thereto. The cutting element 37 has at its lower face a plurality of radially extending cutting edges 38 which define an annular cutting area encircling a central axial passage 39 through the cutting element 37 and having an outer edge at a radius equal to the maximum diameter of the milling head. The aforementioned cup-shaped aluminum plugs projecting from the inner wall of a well casing are readily milled off by rotating and moving the milling tool downwardly through the casing on the end of a drill string.

The valve assembly comprising the valve body 22 and supporting member 32 includes a check valve ball 40 held against the lower valve seat 27 by a compression spring 41 forming a check valve preventing upward flow of gas through the valve body 22. The supporting member 32 is initially made as a cup-shaped generally cylindrical member, but it is then cut to form three flat axially extending sides 42 at equal angles with respect to each other as seen in FIG. 3. The three remaining spaced portions 43 of the outer cylindrical surface of the supporting member 32 extend through arcs of about 20 degrees within which the radially extending shear pin holes 33 are centrally located. The cutting away of the three sides of the supporting member 32 leaves three upwardly extending fingers which support the valve body 22 and provides freer flow of fluids through the check valve. Downward movement of the check ball 40 within the support member 32 is limited by a shoulder area 44 and the spring 41 is retained in this position of the ball within a well between the shoulder area 44 and a radially inwardly extending flange 45 at the bottom of the support member without the spring being fully compressed.

Figure 5:
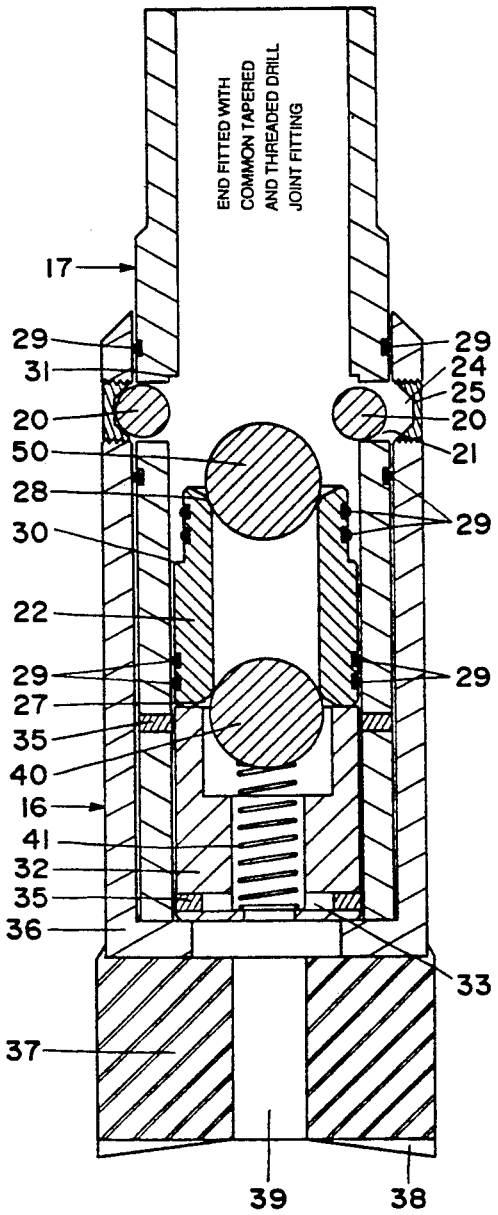
FIG. 5 is a section similar to FIG. 3, but showing the addition of a drop ball atop the valve assembly and with the latter displaced to a position enabling separation of the milling head from its driving and support structure.

When it is desired to separate the milling head 11 from the driver 12 and the milling head is positioned with sufficient space therebeneath to allow it to drop free of the driver 12, a ball 50 is dropped down the drill string whereupon the ball 50 seals against seat 28 atop the valve body 22 and prevents downward flow of fluid through the valve body 22. Fluid pressure applied by the operator through the drill string is raised to about 1500 pounds per square inch to exert a sufficient predetermined force on the ball 50 and valve body 22 and through the valve assembly to effect shearing or fracturing of the shear pins 35. The valve assembly is thus moved to the position of FIG. 5 wherein the clutch balls 20 fall free inwardly or are cammed inwardly by the inclined sides of recesses 24 in plugs 25 to permit the milling head 11 to slide free of the driver 12. Downwardly exerted pressure on ball 50 and valve body 22 is transferred through the valve assembly to the flange 36 to positively push the milling head 11 with the valve assembly therein free of the driver 12.

Figure 1:
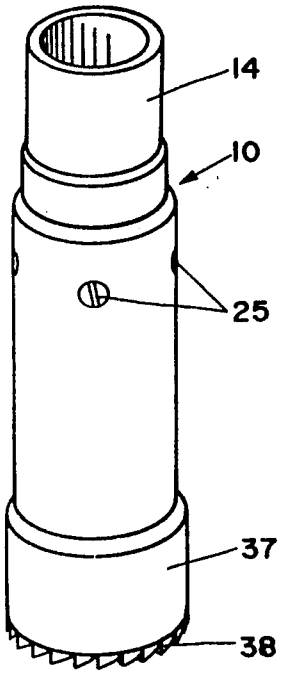
FIG. 1 is a perspective view of a milling tool assembly for attachment to a drill string.

The method of assembling the milling tool assembly 10 as seen in FIGS. 1 and 4 involves the steps of: (a) sliding the check valve assembly including body 22 and support member 32 into the end of the tubular member 17; (b) driving shear pins into the aligned holes 33 and 34; (c) sliding the tubular member 16 of the milling head over the end of the tubular member 17 and positioning the holes 21 therein in alignment with the holes 26 in member 17; (d) inserting a clutch ball 20 into each of the sets of aligned holes; (e) manually screwing retaining cups 25 into the threaded holes in tubular member 16 to firmly retain the clutch balls against the body 22; and (f) anchoring the retaining cups in place and assuring by inspection, and grinding if necessary, that no portion of the cups or any anchoring material remains outside of the peripheral cylindrical outer surface of the tubular member 17.

The tubular sleeve member 16 of the milling head 11 is preferably located to the outside of the driver tubular sleeve member 17 in order to help insure sufficient space for free passage of drilling or other fluids around the end of the hollow drilling string after release of the milling head. However, in an alternative embodiment the relative positions of these members could be reversed with the following changes: the upper end of the outer tubular member 16 would be permanently connected to the driver just below the threaded connection and the lower end of member 16 severed from the milling cutter element 37, the portion of the illustrated inner tubular member 17 would be severed from the driver just above the ball clutch and the lower end of the tubular member 17 permanently connected to the cutting element 37, the other parts remaining in their same relative positions with essentially the same functions. However, in this case of course the shear pins would be interconnecting the valve assembly support member 32 to the separable milling head.

Another alternative embodiment would provide screw plugs, similar to the plugs 25 over clutch balls 20 but with smooth inner ends, to permit insertion of the shear pins from the outside of the tool structure after the milling head is moved to the position shown in FIG. 4. In this case a tool such as an allen wrench can be inserted through the passage 39 in the cutting element 37 to enter an hexagonal opening at the center of flange 45 to manipulate the support member 32 to properly align the holes 33 and 34 for receiving the shear pins 35. The same tool can be used to assure that the valve assembly is in its uppermost position as seen in FIG. 4 with the shoulders 30 and 31 in abutment and with the support member 32 against the valve body 22.

Other variations within the scope of this invention will be apparent from the described embodiment and it is intended that the present descriptions be illustrative of the inventive features encompassed by the appended claims.

What is claimed is:

1. A tubular drill string tool assembly for downward insertion into a well and having a head selectively detachable from the assembly while said assembly is within the well, said assembly comprising a pair of inner and outer axially separable telescoped rotatable tubular members, means for connecting a first of said members to a driving drill string, the other of said members being connected to said head, clutch means for interconnecting said members, said clutch means having a first condition in which the clutch means prevents axial separation of the members and a second condition in which the members can be axially separated to permit detachment of the head from said assembly, said clutch means including at least one clutch element, each said clutch element connecting said telescoped tubular members for rotatable driving connection between said first member and said head and to prevent relative axial movement relative to each other when said clutch means is in said first condition, an axially slidable valve assembly generally concentric with said tubular members, said valve assembly including a structure engageable with said clutch means and movable from a first position in which the structure holds the clutch means in its first condition to a second position in which the structure releases the clutch means to permit disconnection of the telescoped tubular members, releasable holding means responsive to a predetermined downward force on said valve assembly relative to said first member for releasably securing said structure to one of said members to retain the structure in its first position until the predetermined downward force is exceeded, said valve assembly including a check valve to allow flow of a fluid from the string through said members but preventing reverse fluid flow therethrough, said valve assembly having above said check valve an upwardly facing valve seat configured to receive a self-guided sealing stopper dropped through the string for sealing against said valve seat to prevent flow of fluid from the string through said first member until sufficient pressure of the fluid in the string is exerted on the valve assembly to produce a net downward force on said valve assembly which exceeds said predetermined force, the structure being movable by such pressure from its first position to its second position to release the clutch means to permit total separation of the detachable head from the drill string assembly.

2. A tubular drill string assembly with detachable head according to claim 1 wherein said first member is located within the other member.

3. A tubular drill assembly with detachable head according to claim 1 wherein said valve assembly is axially movable within said first member and is separable therefrom along with the detachable head.

4. A tubular drill string assembly with detachable head according to claim 1 wherein said releasable holding means comprises shear pins which fracture when said predetermined force is exceeded.

5. A tubular drill string assembly with detachable head according to claim 1 wherein said valve assembly structure comprises a single movable valve member engaging each said clutch element for holding said clutch means in its first condition, said valve member having thereon, in addition to said upwardly facing valve seat, a valve seat forming part of said check valve.

6. A tubular drill string assembly with detachable head according to claim 1 including a stop means on the inner wall of said first telescoped tubular member, and independent of each said clutch element, to prevent said valve assembly from being moved upwardly in said first tubular member in response to fluid pressures in said tool assembly beneath said check valve.

7. A tubular drill string assembly with detachable head according to claim 1 wherein each such clutch element of said clutch means is a ball secured in a respective pair of mating recesses in said telescoped tubular members.

8. A tubular drill string assembly with detachable head according to claim 7 wherein said valve assembly structure comprises a single movable valve member having a cylindrical outer wall engaging and holding each said ball to retain said clutch means in its first condition, said valve member having thereon, in addition to said upwardly facing valve seat, a valve seat forming part of said check valve.

9. A tubular drill assembly with detachable head according to claim 1 including sealing means for preventing fluid pressure within said drill string from bypassing said valve assembly when a stopper is in place in sealing engagement against said upwardly facing valve seat until said clutch means is released.

10. A tubular drill string assembly with detachable head according to claim 9 wherein said sealing means comprises O-ring seals between said telescoped tubular members and between the inner tubular member and said valve assembly.

11. A tubular drill string assembly with detachable head according to claim 7 wherein there are a plurality of said balls secured in place within said tool assembly by individual cups retained at circumferentially spaced points in the outer one of said telescoped members.

12. A tubular drill string assembly with detachable head according to claim 11 wherein said valve assembly is separable from said tool assembly along with said head.

13. a tubular drill string tool assembly for downward insertion into a well and having a head selectively detachable from the assembly while said assembly is within the well, said assembly comprising a pair of inner and outer axially separable telescoped rotatable tubular members, means for connecting the inner of said members to a driving drill string, the outer of said members being connected to said head, ball clutch means for interconnecting said members, said ball clutch means having a first condition in which the clutch means prevents axial separation of the members and a second condition in which the members can be axially separated to permit detachment of the head from said assembly, said clutch means including at least one clutch ball element, each said clutch ball element connecting said telescoped tubular members for rotatable driving connection between said first member and said head and to prevent relative axial movement realtive to each other when said clutch means is in said first condition, an axially slidable valve assembly generally concentric with said tubular members, said valve assembly including a structure engageable with each said ball element and movable from a first position in which the structure holds the ball element to hold said clutch means in its first condition to a second position in which the structure releases the ball element to enable operation of the clutch means to its second condition, shear-releasable holding means responsive to a predetermined downward force on said valve assembly relative to said inner member for releasably securing said structure to said inner member to retain the structure in its first position until the predetermined downward force is exceeded, said valve assembly including a check valve to allow flow of a fluid from the string through said members but preventing reverse fluid flow therethrough, said valve assembly having above said check valve an upwardly facing valve seat configured to receive a self-guided sealing stopper dropped through the string for sealing against said valve seat to prevent flow of fluid from the string through said inner member until sufficient pressure of the fluid in the string is exerted on the valve assembly to produce a net downward force on said valve assembly which exceeds said predetermined force, the structure being movable by such pressure from its first position to release the clutch means to permit total separation of the detachable head from the drill string assembly.

14. A tubular drill string assembly with detachable head according to claim 13 wherein said valve assembly is slidable within said inner member and is separable therefrom along with the detachable head.

15. A tubular drill string assembly with detachable head according to claim 14 wherein said valve assembly comprises a single movable valve member engaging each such ball element for holding said clutch means in its first condition, said valve member having thereon, in addition to and said upwardly facing valve seat, a seat forming part of said check valve.

16. A tubular drill string assembly with detachable head according to claim 15 including a stop means on the inner wall of said first telescoped tubular member, and independent of each said clutch ball element, to prevent said valve assembly from being moved upwardly in said first tubular member in response to fluid pressures in said tool assembly beneath said check valve.

17. a tubular drill assembly with detachable head according to claim 13 including sealing means for preventing fluid pressure within said drill string from bypassing said valve assembly when a stopper is in place in sealing engagement against said upwardly facing valve seat until said clutch means is released.

18. A tubular drill string assembly with detachable head according to claim 13 wherein said valve assembly is separable from said tool assembly along with said head.

19. The method of drilling in a well with a drilling tool on the end of a hollow drill string and separating the drilling tool from the drill string without withdrawing the string from the well comprising: mounting on an lower open end of a drill string a cutting head assembly having a member connected to and rotated by the drill string and a member having a cutting head of the drilling tool thereon, said assembly having ball clutch elements interconnecting said members for rotatable driving connection therebetween and to prevent separation of said members, said assembly having a pressure responsive release mechanism responsive to an actuating pressure on the release mechanism to release the connection by said ball elements between said members to release the cutting head and the mechanism from the string, the release mechanism having a valve structure for retaining the ball elements in said interconnecting relationship the valve structure having an upwardly open passage and a downward flow permitting check valve for passing cutting fluid from the string through the passage to the cutting head, passing into the well casing the drill string with the separable cutting head on the lower end of the string, drilling by rotating the cutting head and lowering the head on the end of the string in the well, after cutting to a desired position, positioning the string to provide sufficient space therebeneath to enable the cutting head to drop from the drill string, dropping a sealing member through the drill string to close said passage, increasing the pressure of fluid in said string to a pressure sufficient to create a pressure on said pressure responsive release mechanism to release said interconnection between said members to release the cutting head from the string and maintaining fluid flow through the string to enable the cutting head and the release mechanism to drop free of the open lower end of the string.

20. A method according to claim 19 for providing open gas ports in the wall of a well casing and assuring free flow of gas production through a drill string in the well, the well casing having plugs sealing said ports, the sealing plugs having hollow portions projecting inwardly from the inner casing wall, the cutting head being a milling head, said drilling being a milling operation to cut off said hollow inwardly projecting portions to open the gas flow ports through the well casing wall, said desired position corresponding to a position assumed by the head upon milling off all the inwardly projecting portions of said plugs.

* * * * *